US009301031B2

(12) United States Patent
Gengler et al.

(10) Patent No.: US 9,301,031 B2
(45) Date of Patent: Mar. 29, 2016

(54) MODULAR SPEAKER SYSTEM, COMPONENTS OF A MODULAR SPEAKER SYSTEM, AND METHODS OF USING THE SAME

(71) Applicant: ZAGG Intellectual Property Holding Co., Inc., Salt Lake City, UT (US)

(72) Inventors: David Gengler, Draper, UT (US); Arthur Healey, Centerville, UT (US); Jeffrey King, Kaysville, UT (US); Terence Hulsman, North Salt Lake, UT (US)

(73) Assignee: ZAGG Intellectual Property Holding Co., Inc., Salt Lake City, UT (US)

( * ) Notice: Subject to any disclaimer, the term of this patent is extended or adjusted under 35 U.S.C. 154(b) by 0 days.

(21) Appl. No.: 13/903,701

(22) Filed: May 28, 2013

(65) Prior Publication Data

US 2013/0259283 A1 Oct. 3, 2013

Related U.S. Application Data

(60) Provisional application No. 61/651,640, filed on May 25, 2012.

(51) Int. Cl.

| | |
|---|---|
| ***H04R 1/00*** | (2006.01) |
| ***H04R 5/02*** | (2006.01) |
| ***H04R 5/04*** | (2006.01) |
| *H04R 1/02* | (2006.01) |

(52) U.S. Cl.

CPC .. *H04R 1/00* (2013.01); *H04R 5/02* (2013.01); *H04R 1/025* (2013.01); *H04R 5/04* (2013.01); *H04R 2205/021* (2013.01); *H04R 2420/01* (2013.01); *H04R 2420/07* (2013.01)

(58) Field of Classification Search

CPC .. G06F 1/1632; H04R 2205/021; H04R 5/02; H04R 2499/11; H04R 1/02; H04R 5/04; H04R 1/025; H04R 1/00; H04R 2420/07; H04R 2420/01; H04M 1/72527; H04M 1/72575; H04M 1/0274; H04M 1/0256; H04M 1/0254; H04M 1/026; H04M 1/21

USPC ..... 700/94; 381/77, 80, 81, 123

See application file for complete search history.

(56) References Cited

U.S. PATENT DOCUMENTS 6,813,528 B1 * 11/2004 Yang ..... 700/94
7,764,806 B2 * 7/2010 Pei et al. ..... 381/335

(Continued)

*Primary Examiner* — Ping Lee

(74) *Attorney, Agent, or Firm* — Durham Jones & Pinegar, P.C. Intellectual Property Law Group

(57) ABSTRACT

A multi-speaker audio system is configured to provide flexible use of speakers in any number of different environments. The multi-speaker system may include a stationary speaker unit and a portable speaker unit. The portable speaker unit may be operated in conjunction with, or separate from, the stationary speaker unit. When connected or otherwise used with the stationary speaker unit, the portable speaker unit may receive audio signals and pass at least some of the signals and/or corresponding data to the stationary speaker unit for output. When disconnected from the stationary speaker unit, the portable speaker unit may receive audio signals and output sound accordingly. The stationary speaker unit may also be able to receive audio signals and pass at least some of the signals or corresponding audio data to the portable speaker unit or output the data itself. The speaker units may be physically coupled to each other, such as by connecting the speaker units using an adapter or port, joining electrical leads, or nesting the portable speaker unit at least partially within the stationary speaker unit.

23 Claims, 5 Drawing Sheets

(56) References Cited

U.S. PATENT DOCUMENTS

2003/0078071 A1* 4/2003 Uchiyama ..... 455/557
2004/0122543 A1* 6/2004 Lee et al. ..... 700/94
2004/0162029 A1* 8/2004 Grady ..... 455/42
2008/0123285 A1* 5/2008 Fadell et al. ..... 361/686
2010/0150276 A1* 6/2010 Yew et al. ..... 375/340

* cited by examiner

MODULAR SPEAKER SYSTEM, COMPONENTS OF A MODULAR SPEAKER SYSTEM, AND METHODS OF USING THE SAME

CROSS-REFERENCE TO RELATED APPLICATION

A claim is hereby made pursuant to 35 U.S.C. §119(e) for the benefit of priority to the May 25, 2012 filing date of U.S. Provisional Patent Application No. 61/651,640 for MODULAR SPEAKER SYSTEM, COMPONENTS OF A MODULAR SPEAKER SYSTEM, AND METHODS OF USING THE SAME (the "'640 Provisional Application"). The entire disclosure of the '640 Provisional Application is, by this reference, incorporated herein.

TECHNICAL FIELD

The present disclosure relates generally to audio output devices, such as speakers. More specifically, this disclosure relates to audio output devices that include two or more speaker units, such as a stationary speaker unit and a portable speaker unit, that are configured to be used together and to be used separately from one another.

RELATED ART

Portable speakers are often used with portable electronic devices, such as MP3 players (e.g., dedicated audio devices, such as the IPOD® portable digital music player available from Apple, Inc., etc.), smart phones, tablet computing devices, laptop or notebook computers, PDAs, CD players, and the like. To be portable, the speakers are normally compact and lightweight.

Being compact and lightweight, portable speakers provide reduced space for audio components. Additionally, because they are often transported and/or used in a variety of conditions, portable speakers are frequently damaged. Since their useful lives may be limited, and so they can be economically replaced, portable speakers are often produced with low cost components. Furthermore, to reduce power consumption and extend battery life, lower power components may also be used. As a result of size, cost, and/or power considerations, portable speakers generally do not include certain audio components that could provide an output quality, volume or intensity comparable to a larger, stationary speaker.

When the user is on-the-go, the portability and low power consumption and/or volume of a portable speaker may be useful or even desirable. However, although the quality, volume our output intensity of a portable speaker may be acceptable to some people under some circumstances, because of their generally low quality, volume and/or output intensities, their use is often impractical or undesirable in a variety of other environments, such as in a large room in a home or office. In such environments, a user wanting a high quality audio experience, to amplify sound or to increase volume may want an audio system with larger, less portable, and/or more powerful components. Thus, users who want to benefit from portability under some circumstances, but high quality, volume and/or output intensity in other situations, typically have to purchase multiple audio output devices.

SUMMARY

In various embodiments, the present disclosure relates to audio systems with multiple speaker units that are separable and separately useable, but may also be used together. Such an audio system may also be referred to herein as a "multi-speaker system." An audio system of this disclosure includes two or more speaker units configured to be used separately or together in a manner that provides flexibility for audio, or sound, output in a number of different environments and under a number of different circumstances. In some embodiments, an audio system may include a pair of speaker units, including a stationary speaker unit and a portable speaker unit. The speaker units of such an audio system may be modular. Each speaker unit may include one or more individual speakers. The speaker units may be configured to be physically, wirelessly, or otherwise operably coupled with one another.

In a more specific embodiment, an audio system may include a portable speaker unit, which may be operated in conjunction with, or separate from, a stationary speaker unit. In some embodiments, the portable speaker unit may receive audio signals (e.g., digital signals carrying data, analog signals, etc.) from an audio source. The speaker units may be physically coupled, such as by connecting the speaker units using an adapter or port or nesting the portable speaker unit at least partially within the stationary speaker unit, and establishing electrical communication between corresponding leads. Alternatively, the speaker units may be wirelessly connected or otherwise communicate with each other via a wireless communication protocol.

When the portable speaker unit is coupled with the stationary speaker unit, physically or wirelessly, or the portable speaker unit is otherwise used with the stationary speaker unit, the portable speaker unit may pass at least a portion of the audio signals (e.g., the data, etc.) received from the audio source to the stationary speaker unit to output sound. When the portable speaker unit is disconnected from the stationary speaker unit, the portable speaker unit may directly output sound. In some embodiments, the stationary speaker unit may receive an audio signal and pass at least a portion of the audio signal to the portable speaker unit to output sound and/or the stationary speaker unit may output at least some of the sound itself.

A first speaker unit of a multi-speaker system may include a coupling element, such as a feature for receiving, but not necessarily engaging, a second speaker unit of the multi-speaker system. The coupling element may comprise a speaker mount configured to selectively receive or otherwise engage the second speaker unit. The speaker mount may comprise an integrally formed part of the first speaker unit, it may be connected to the first speaker unit using fasteners, by therein, or it may be associated with the first speaker unit in any number of other ways. In a specific embodiment, the speaker mount may include a recess or receptacle within a body of the first speaker unit. Such a recess or receptacle may have a shape and configuration corresponding to all or a portion of the body of the second speaker unit.

According to at least some embodiments of the present disclosure, the speaker mount of a multi-speaker system may be configured to enable the second speaker unit to at least partially nest with the first speaker unit. In some cases, one of the speaker units may include a stationary speaker unit designed or otherwise configured to provide a high quality, high volume, and/or high intensity sound output, while the other speaker unit may be designed or otherwise configured for portability and, thus, comprise a portable speaker unit with a lower quality, lower volume or lower intensity audio output. The speaker units may each have a speaker body.

The speaker mount of a multi-speaker system may seamlessly or substantially seamlessly (e.g., with a discernable boundary, coordinating features, etc.) integrate the first and second speaker units. A speaker mount optionally mounts the second speaker unit in a manner that is flush with one or more exterior surfaces of the first speaker unit. Multiple sections, materials, or segments of the first speaker unit may also match corresponding portions of the second speaker unit such that the second speaker unit visually blends with the first speaker unit when the first and second speaker units are assembled with one another.

One or both of the first and second speaker units may include user interface controls. Such controls may be on an exterior of a body of one or both of the first and second speaker units. Example interface controls may control volume, power on/off functions, audio device discovery, audio device syncing, equalizer functions, or other operations of the first and/or second speakers.

A multi-speaker system may include a physical (e.g., by way of wires, connectors, etc.) or wireless audio input for receiving audio signals from a selectively connectable audio source. The audio source may include a portable or stationary audio input device. One or both of the first and second speaker units may include an audio input configured to receive audio signals directly from the audio source. In some embodiments, the second speaker unit (e.g., a portable speaker unit, etc.) includes the audio input and, thus, receives audio signals from the audio source. The second speaker unit may act as an audio bypass by providing some or all of the received data from the audio signals to the first speaker unit (e.g., a stationary speaker unit, etc.), which provides a sound output. Such a bypass may occur when the first and second speakers are selectively coupled to one another. Alternatively, or in addition, the second speaker unit may output sound.

During operation, the first and second speaker units (e.g., portable and stationary speaker units, respectively, etc.) may operate independently and/or in a coordinated manner. In one embodiment, the first and second speaker units are configured to operate independently from one another when one of the speaker units (e.g., the portable speaker, etc.) is selectively uncoupled from the other speaker unit (e.g., the stationary speaker unit, etc.). In another embodiment, the first and second speaker units are configured to operate in a coordinated manner when coupled with one another. In still another embodiment, one speaker unit (e.g., the portable speaker unit, etc.) may be configured to pass audio signals or data to the other speaker unit (e.g., the stationary speaker unit, etc.) when the speaker units are coupled. Optionally, the first and second speaker units may be configured to selectively operate in each of independent and coordinated modes. In this regard, a switching component may be included in some embodiments of a multi-speaker system. A switching component may determine whether to send the audio signals or data to one or both of the first and second speaker units and to cause one or both of the first and second speaker units to output sound. In some cases, the switching component may evaluate whether a direct and/or physical connection exists between the portable speaker unit and the stationary speaker unit at a speaker mount or other coupling element.

In another aspect, a method for using a multi-speaker system with an audio source is disclosed. Such a method may include coupling at least two speaker units with one another. Coupling may include physical attachment, wireless coupling or any other suitable type of coupling. As an example, such a method may include inserting a first speaker unit into a receiving portion of a second speaker unit. The first speaker unit can be portable relative to the second speaker unit. A communicative link (wired or wireless) can be established between an audio input device and at least one of the first or second speaker units. In establishing the communicative link, the first and second speaker units may operate in a coordinated manner to output audio signals or data received from the audio input device. In some embodiments, the first speaker unit can be selectively removed from the second speaker unit, which may result in the first and second speaker units ceasing to operate in a coordinated manner.

Other aspects, as well as the features and advantages of various aspects, of the disclosed subject matter will become apparent to those of ordinary skill in the art through consideration of the ensuing description, the accompanying drawings and the appended claims.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope and that, while drawn to scale for certain embodiments, such drawings are not necessarily drawn to scale for all embodiments, various embodiments will be described and explained with additional specificity and detail through the use of the accompanying drawings in which.

DETAILED DESCRIPTION

Figure 1A:
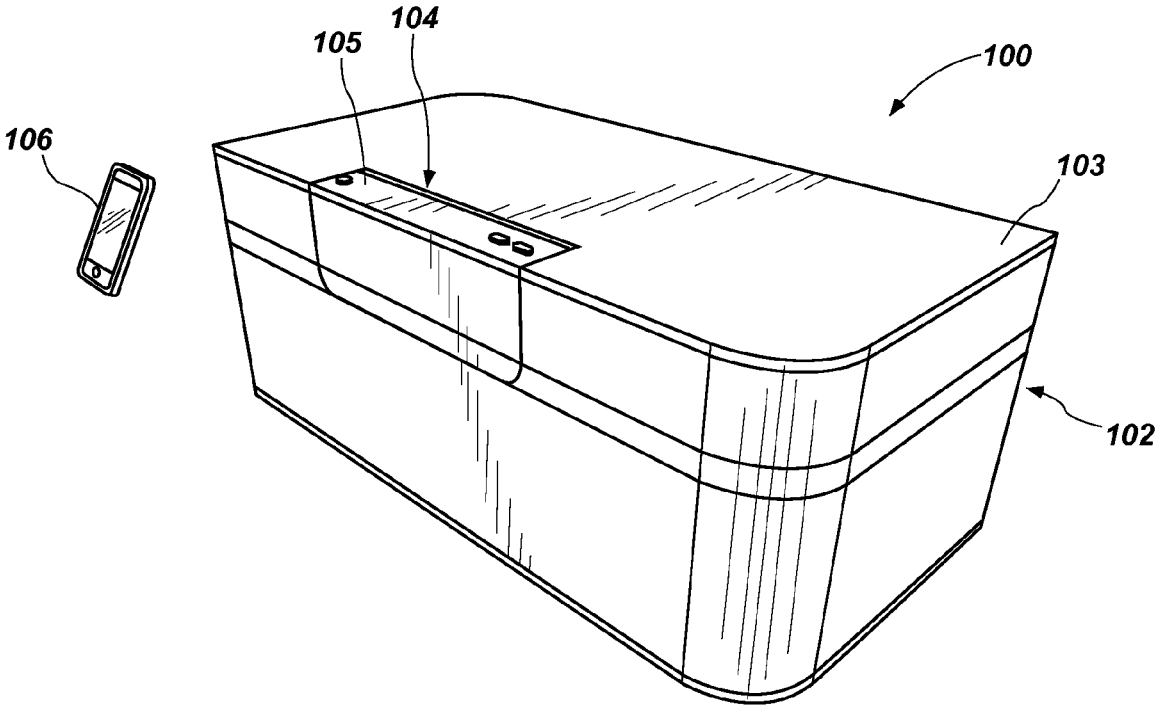
FIG. 1A is a perspective view of a multi-speaker system according to an embodiment of the present disclosure, the multi-speaker system including a stationary speaker unit and a portable speaker unit.

Aspects of the present disclosure relate generally to audio systems and, more particularly, to speaker systems that can be used in conjunction with an audio source to play or otherwise output sound, or audio signals from a variety of different speaker units, separately or in one or more different combinations. Examples of audio sources may include, but are not limited to, portable or stationary components. By way of illustration, portable audio input devices may include any number of devices, including, without limitation, digital media players (e.g., an ITOUCH, IPOD, etc.), smart phones, e-readers (e.g., a KINDLE or NOOK e-reader), laptop computing devices, so-called "slate" or "tablet" computers (e.g., an IPAD, XOOM, PLAYBOOK, or GALAXY TAB tablet computing device). Stationary audio sources may include desktop computers, televisions, optical disk players (e.g., DVD, BLU-RAY, etc.), set-top-boxes, audio receivers, stereos, audio recording equipment, or other devices that generally remain in one physical location during use.

The principles and uses of the teachings of the present disclosure may be better understood with reference to the accompanying description, figures and examples. It is to be understood that the details set forth herein do not construe a limitation to an application of the disclosure. Furthermore, it is to be understood that the present disclosure and embodiments related thereto can be carried out or practiced in various ways and that aspects of the present disclosure can be implemented in embodiments other than the ones outlined in the description below.

If the specification or claims refer to "an additional" element, feature, aspect, or the like, that does not preclude there being exactly one or more than one of the additional element. It is to be understood that where the claims or specification refer to "a," "an" or "the" element, such reference is not to be construed that there be only one of that element. It is further to be understood that where the specification states that a component, feature, structure, or characteristic "may", "might", "can" or "could" be included, that particular component, feature, structure, or characteristic is not required to be included, but may be optional or non-essentially included in some embodiments of the present disclosure. Absent language indicating that any component is essential or required, such a component should also be understood to be optional or non-essentially included.

Methods of the present disclosure may be implemented by performing or completing manually, automatically, or a combination thereof, selected steps or tasks. The term "method" refers to manners, means, techniques and procedures for accomplishing a given task including, but not limited to, those manners, means, techniques and procedures either known to, or readily developed from, known manners, means, techniques and procedures by practitioners of the art to which the present disclosure belongs. The descriptions, examples, methods and materials presented in the claims and the specification are not to be construed as limiting but, rather, as illustrative only.

Meanings of technical and scientific terms used herein are to be commonly understood by one of ordinary skill in the art to which embodiments of the present disclosure belong, unless otherwise defined. Embodiments of the present disclosure can be implemented in the testing or practice with methods and materials equivalent or similar to those described herein.

Directional or relative terms such as, but not exclusively including, "bottom", "below", "top", "above", "back", "front", "left", "right", "rear", "forward", "up", "down", "horizontal", "vertical", and the like as used herein do not necessarily indicate, for example, that a "bottom" component necessarily be placed below a "top" component, that a component that is "below" is necessarily "below" another component, or that a component that is "above" is necessarily "above" another component. As such, directions, components or both may be flipped, rotated, moved in space, placed in a diagonal orientation or position, moved horizontally or vertically, or similarly modified. Accordingly, it will be appreciated that such example terms are to be used herein for exemplary purposes only, and primarily relative to the illustrations in the appended figures, to illustrate example relative positioning or placement of certain components, to indicate a first and a second component or to do both.

FIGS. 1A-1D generally illustrate a multi-speaker system 100 for use with one or more audio sources, according to some embodiments of the present disclosure. As shown, a multi-speaker system 100 may include a first speaker unit 102 and a second speaker unit 104. In some embodiments, the first speaker unit 102 may be a stationary speaker intended to primarily remain in a particular location. In additional embodiments, the second speaker unit 104 may be a portable speaker having a size, shape and configuration and/or a power supply suitable to allow the second speaker unit 104 to be efficiently moved from place to place. In at least some embodiments, the second speaker unit 104 may connect to an audio source 106, which transmits audio signals or data, while the second speaker unit 104 is configured to be moved away or displaced from the first speaker unit 102. In other embodiments, the first speaker unit 102 may also connect to the audio source 106, either directly or through the second speaker unit 104.

As shown in FIGS. 1A-1D, the first speaker unit 102 of the multi-speaker system 100 is optionally larger relative to the second speaker unit 104. The second speaker unit 104 may also connect to the first speaker unit 102. Such a connection may be done in any number of ways. For instance, for a physical connection, a wire, connector or adapter may be used. Such a connection may also include a communicative or electrical link. For instance, a physical connector may include one or more pins, wires, leads or other electrical connectors that allow power and/or communication to pass between the first speaker unit 102 and the second speaker unit 104. In some embodiments, a connection may be purely communicative. A connection may include, for instance, a wireless (e.g., AirPlay, Bluetooth, 802.11, radio frequency, near field communication, etc.) connection by which data may be transmitted.

Figure 1B:
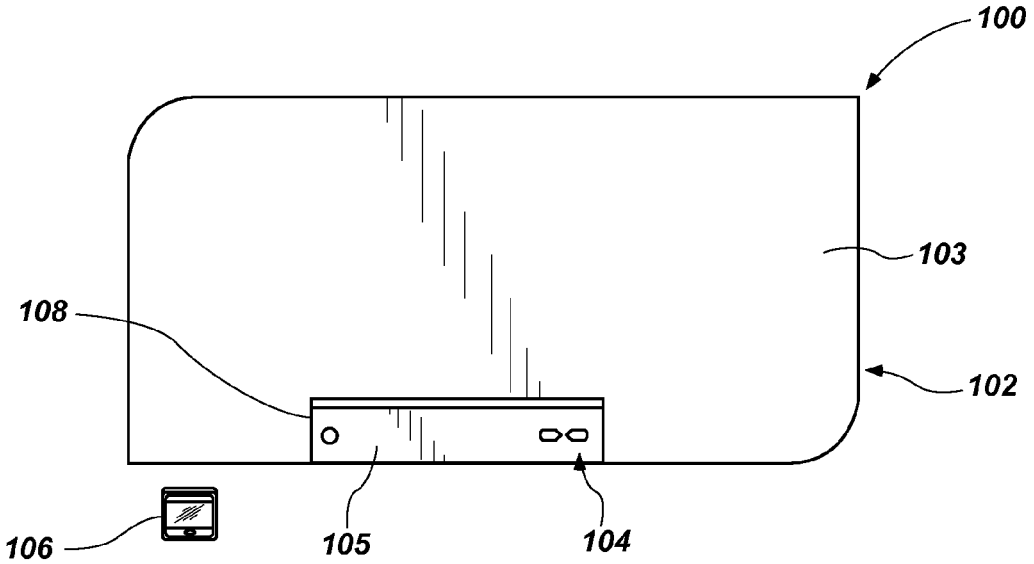
FIG. 1B is a top plan view of the multi-speaker system of FIG. 1A.
Figure 1C:
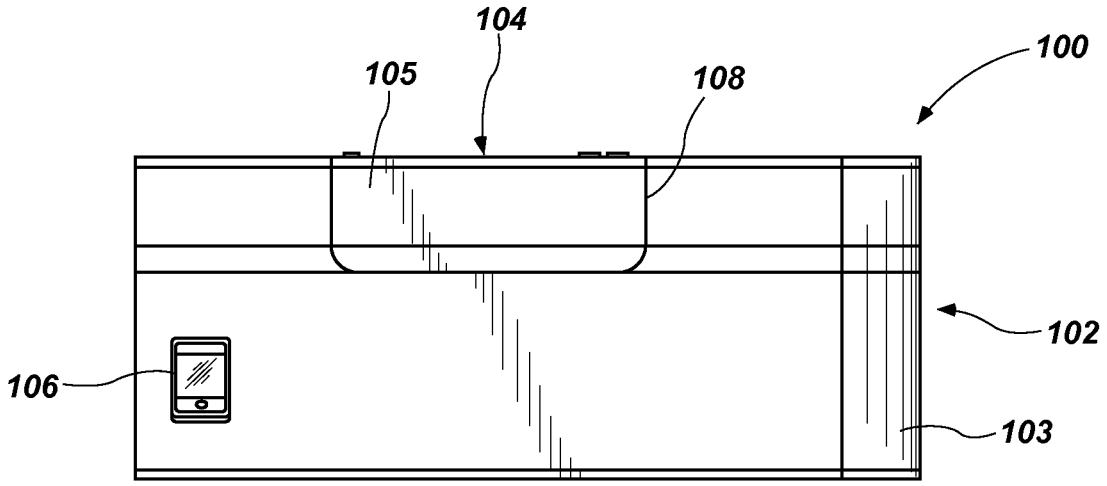
FIG. 1C is a front view of the multi-speaker system of FIG. 1A.
Figure 1D:
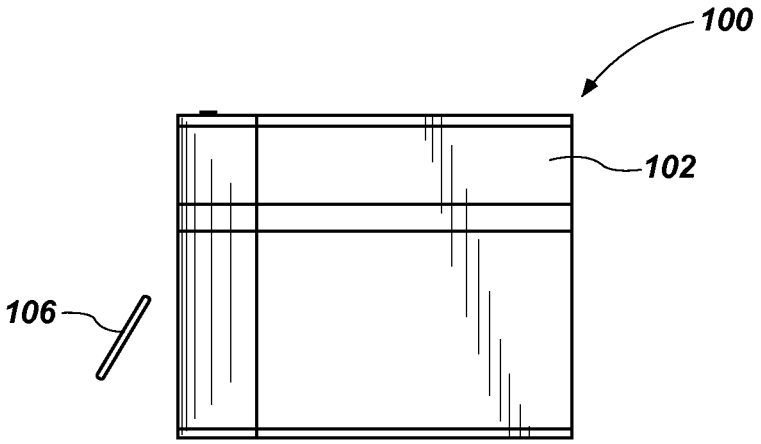
FIG. 1D is a side view of the multi-speaker system of FIG. 1A.

In additional or other embodiments, a physical connection between the first and second speaker units 102, 104 may be provided. As shown in FIGS. 1A-1C, for instance, the first speaker unit 102 may include a speaker body 103 while the second speaker unit 104 may include its own speaker body 105. In some cases, the speaker body 103 is configured to nest fully or partially within the speaker body 105 of the second speaker unit 104. By way of example, a receptacle 108 may be defined in the speaker body 103 for receiving or otherwise engaging all or a portion of the body 105 of the second speaker unit 104. In the illustrated embodiment, for instance, the second speaker unit 104 may be positioned substantially fully within the receptacle 108. In some embodiments, the receptacle 108 has about the same size and shape as the body 105 of the second speaker unit 104 so that exterior portions of the second speaker unit 104, when at least partially inserted into the receptacle 108, are substantially flush with adjacent exterior portions of the speaker body 103 of the first speaker unit 102. Moreover, while the illustrated embodiment depicts the receptacle 108 at a location where top and front surfaces of the speaker body 103 intersect, it should be appreciated that the configuration, size and location of the receptacle 108 are merely illustrative. In other embodiments, for instance, a receptacle may be positioned at a location where additional or other surfaces of the speaker body 103 intersect, or it may even be positioned at a location where no exterior surfaces of the speaker body 103 intersect (e.g., the speaker body 103 could open to a single surface of the speaker body 103, it could be at least partially concealed by a panel or door that opens to receive, and then close around, the second speaker unit 104, etc.).

As discussed herein, the first and/or second speaker units 102, 104 may be linked to an audio source (e.g., audio source 106, etc.) in a manner that enables audio signals or data to be transmitted from the audio source 106, processed (if the audio signals or data is digital to generate an analog audio signal), and amplified and output as sound by one or both of the first and second speaker units 102 and 104 of the multi-speaker system 100. The audio source 106 may communicatively link to one or both of the first and second speaker units 102, 104. In one embodiment, for instance, the audio source 106 may be physically and/or communicatively linked to the second speaker unit 104. Such communication may be facilitated physically; for example, with a wire, connector, adapter, or the like. Alternatively, such communication may occur wirelessly; for example, with a set of communicating wireless receivers/transmitters in the audio source 106 and/or the second speaker unit 104. Regardless of the particular configuration, when the audio source 106 is connected to the second speaker unit 104, the second speaker unit 104 may process audio data, amplify an audio signal and/or output sound based on the audio signals or data from the audio source 106. In some cases, at least some audio signals or data received by the second speaker unit 104 may be transmitted to the first speaker unit 102. The first speaker unit 102 may receive audio signals or data from the second speaker unit 104 and store, process, amplify, or otherwise use the received audio signals or data. Thus, in some cases, the second speaker unit 104 may act as a relay to the first speaker unit 102. While acting as a relay, the second speaker unit 104 may continue to output sound, or its output may be turned off, enabling the first speaker unit 102 to provide all of the sound output.

In other embodiments, the audio source 106 may instead couple to the first speaker unit 102. For instance, one or more wireless transmitter/receivers may be included in the first speaker unit 102 to receive data from the audio source 106 and, optionally, to transmit data to the audio source 106. Alternatively, or in addition, a physical link, such as a connector, adapter or wire may be provided to physically connect the audio source 106 to the first speaker unit 102. Such a physical link may enable the transmission of audio signals or data in one or both directions between the audio source 106 and the first speaker unit 102. In still additional embodiments, the audio source 106 may couple to both of the first and second speaker units 102 and 104.

In at least one embodiment, the multi-speaker system 100 may be configured for use in a stationary environment. For instance, a user of the multi-speaker system 100 may be located in a particular location (e.g., a home, an office, etc.), and the multi-speaker system 100 remains generally stationary within that location. In some cases, the multi-speaker system 100 may also move, such as where the location is a vehicle; however, the multi-speaker system 100 may nonetheless be considered stationary because it remains in a relatively fixed location relative to its enclosure (e.g., the vehicle itself, etc.).

When the user is within the same location as the multi-speaker system 100, the user may connect the audio source 106 to the multi-speaker system 100 in any conventional manner and/or any other manner described or learned from this disclosure. Audio data stored or accessed by the audio source 106 may be transferred, as audio signals, to the multi-speaker system 100. The multi-speaker system 100 may then process and/or amplify the audio signals or data and output sound in a desired manner (e.g., at a desired volume, with desired sound characteristics, etc.). In one embodiment, the multi-speaker system 100 may selectively use one or both of the first and second speaker units 102, 104. In at least one embodiment, while the second speaker unit 104 is connected to the first speaker unit 102, the multi-speaker system 100 may automatically or upon user selection provide sound output solely through the first speaker unit 102 or the second speaker unit 104. In other embodiments, both the first and second speaker units 102, 104 may be used simultaneously (e.g., speakers may provide output for different audio channels, etc.).

Figure 2:
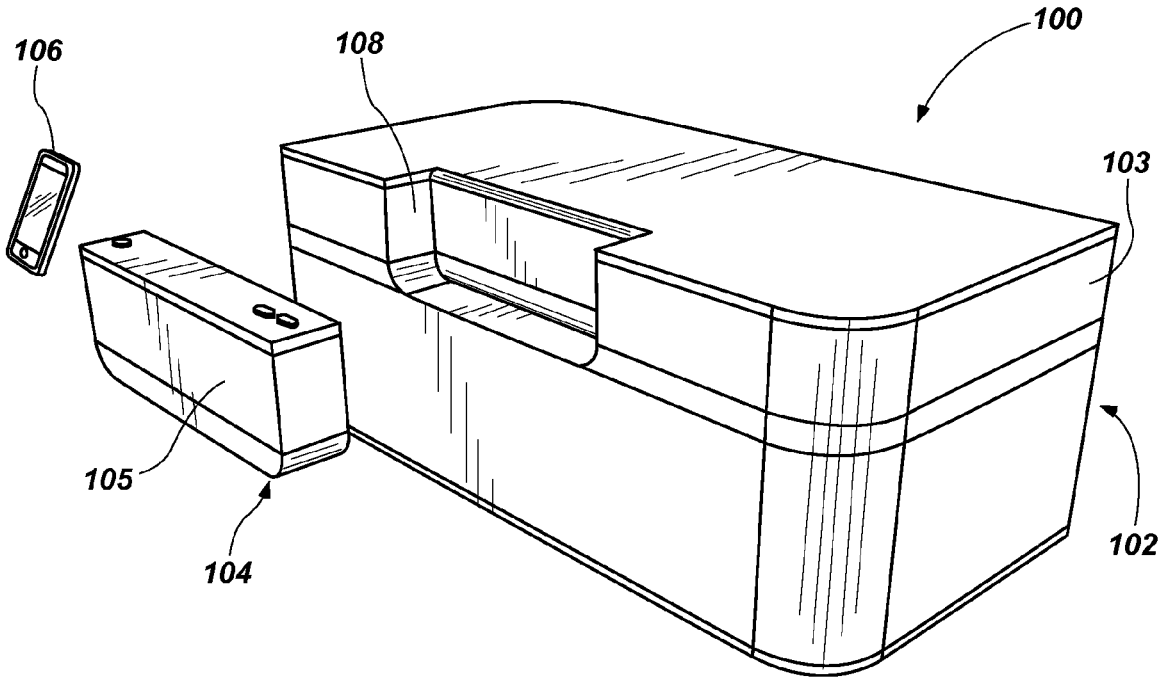
FIG. 2 is a perspective view of the multi-speaker system of FIG. 1A, the portable speaker unit being displaced relative to the stationary speaker unit.

As discussed herein, the first and/or second speaker units 102, 104 may also be movable relative to each other. In one embodiment, for instance, the second speaker unit 104 may be smaller and/or more lightweight relative to the first speaker unit 102. In such an embodiment, the second speaker unit 104 can optionally be detached or disengaged from, or otherwise uncoupled from, the first speaker unit 102. An example manner of uncoupling the second speaker unit 104 from the first speaker unit 102 is illustrated in FIG. 2. More particularly, in the illustrated embodiment, the speaker body 105 of the second speaker unit 104 may be removed from a receptacle 108 defined by the speaker body 103 of the first speaker unit 102. In other embodiments, however, the speaker body 105 may be detached from any other physical structure on, connected to, or defined by the speaker body 103 of the first speaker unit 102.

In detaching the second speaker unit 104 from the first speaker unit 102, a user may enable the multi-speaker system 100 to be operated asynchronously. As an illustration, the second speaker unit 104 may be lightweight, small in size, or otherwise configured to be portable relative to the first speaker unit 102 and/or a structure containing the first speaker unit 102. A user may, for instance, carry the second speaker unit 104 while exercising, while going to or from work, while on a vacation, or for any number of other occasions. While on-the-go, the user may be able to connect the audio source 106 to the second speaker unit 104 without using the first speaker unit 102, and indeed without even being near the first speaker unit 102. Thus, purely by way of example, a user could use the portable second speaker unit 104 while at work to play music or other audio data stored in a multimedia device (e.g., audio source 106, etc.). The multimedia device may be portable and, when the user returns home, the user can play the corresponding audio through the more stationary, first speaker unit 102. Optionally, the first speaker unit 102 can be operated without the portable second speaker unit 104 connected or linked thereto. In other embodiments, a dedicated device may be connected to the first and/or second speaker unit 102, 104. For instance, at an office, a user may connect a computer to the second speaker unit 104, while the first speaker unit 102 may remain at home, where a user may connect a multimedia system that includes a set-top-box, audio receiver, optical disk player, stereo and/or television to the first speaker unit 102. Of course, at any time, the user may also return the portable second speaker unit 104 to the home location and connect the second speaker unit 104 to the first speaker unit 102.

As discussed herein, an audio source 106 may take any number of forms and may connect to the first and/or second speaker units 102, 104 in any suitable manner. In one embodiment, the audio source 106 may include a wireless transmitter. An illustrative wireless transmitter may be configured to communicate using a standard or proprietary protocol with either one of the first and second speaker units 102, 104. Such a wireless transmitter may also broadcast data or otherwise communicate with both the first and second speaker units 102, 104 and/or other devices at the same time. In other embodiments, the audio source 106 may couple to the first and second speaker units 102, 104 using a physical connection. An example of a suitable connection may include an audio wire with mono or stereo jacks on one or both ends thereof. A jack may, for instance, be connected to an audio output port of the audio source 106 and connected to an audio input port of the first speaker unit 102 or the second speaker unit 104. Other physical connections may also be used.

Figure 3:
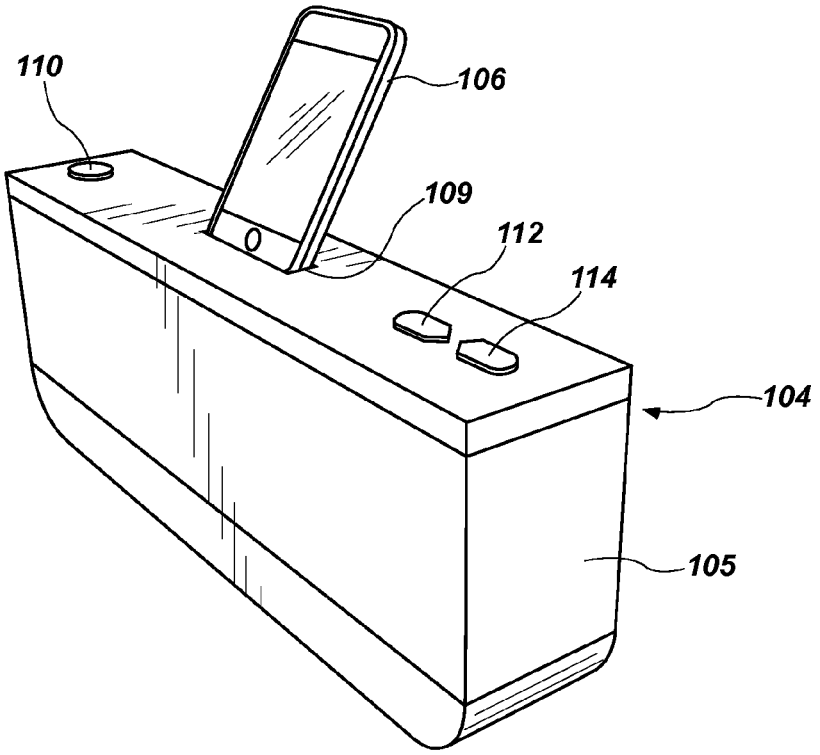
FIG. 3 is a perspective view of an example portable speaker unit similar to the portable speaker unit of FIG. 2.

FIG. 3 illustrates an example second speaker unit 104 that may include a connector and, optionally, an adapter allowing the audio source 106 to be connected to the second speaker unit 104. In this embodiment, a recess 109 may be formed in an outer surface of the speaker body 105 of the second speaker unit 104. The recess 109 may be configured to at least partially receive and to support the audio source 106, and may thus operate as one type of a mount, connector, or other type of connection or mounting component for the audio source 106. In some embodiments, an additional component (e.g., a connector, etc.) may be located within the recess 109 and can optionally connect to a corresponding input/output port on the audio source 106. Such an additional component may enable, for instance, audio data to be transmitted (e.g., as one or more audio signals, etc.) from the audio source 106 to the second speaker unit 104 for processing, amplification, output, or other use. While the recess 109 is depicted as being located in the top surface of the speaker body 105, it should be appreciated that such a configuration and location for the recess 109 are merely illustrative. In other embodiments, for instance, a recess 109 may extend into another surface or into a plurality of adjacent surfaces. Alternatively, a recess 109 may be at least partially concealed (e.g., by a panel or door of the speaker body 105, which could open to receive, and then close around, the audio source 106, etc.). Other embodiments of, the second speaker unit 104 may include an engagement element having a different configuration (e.g., a stand, a connector, etc.) that supports and/or establishes communication with the audio source 106. It should also be appreciated that the first speaker unit 102 (FIG. 2) may include any suitable element for engaging an audio source 106.

In certain embodiments, the first and/or second speaker unit 102 (FIG. 2), 104 may include user interface components to enable a user to interact with the speaker units 102 and 104. FIG. 3 illustrates an example of user interface components 110, 112, 114 that may be used when the second speaker unit 104 is used. Operation of the user interface components 110, 112, 114 may be configured to suit any number of different purposes, as desired. Examples of suitable configurations for the user interface components 110, 112, 114 may include, for instance: power on/off functions; functions for causing one of the speaker units 102, 104 to discover the other speaker unit 104, 102; functions for selecting or syncing operation of the first and second speaker units 102 and 104; volume control functions; audio equalizer functions; or any other function or combination of the foregoing.

The user interface components 110, 112, 114 may take any number of different types as well. In FIG. 3, for instance, the user interface components 110, 112, 114 may include physical buttons that may be used to convey control information. In other embodiments, a touch-screen or other display element may be provided to convey and optionally receive input information. In still another embodiment, control information may be provided through the audio source 106. For instance, an application on the audio source 106 may be used to control operation of the second speaker unit 104. In such an embodiment, a communicative connection between the audio source 106 and the second speaker unit 104 may include the ability to transfer audio data as well as control other data.

Although the user interface components 110, 112, 114 are illustrated on FIGS. 1A-3 as being on the second speaker unit 104, it should be appreciated that such an embodiment is purely illustrative. In other embodiments, for instance, user interface components 110, 112, 114 may be located on the first speaker unit 102 or on both speaker units 102, 104. In other embodiments, visible user interface components may be omitted entirely, such as where the audio source 106 provides controls over a data link or where a remote control is used to operate the first and/or second speaker units 102, 104.

It should be appreciated in view of this disclosure that one or more components of a multi-speaker system such as that disclosed herein may be configured to provide power to operate certain other components. Indeed, in some embodiments, one or both of the first and second speaker units 102 and 104 may each have different components requiring power, and optionally having different power requirements. The first speaker unit 102 of FIGS. 1A-1D may, for instance, have components having a first power requirement while the second speaker 104 may have a different, second power requirement. Optionally, the power requirement for the first speaker unit 102 may be higher than the power requirement for the second speaker unit 104.

The power requirements may be satisfied by including or connecting the first and second speaker units 102, 104 to a suitable power supply. In one embodiment, for instance, the first speaker unit 102 may include a plug or adapter to allow the first speaker unit 102 to be connected to a standard wall outlet for power. Optionally, such a power system may be the only power input system provided for the first speaker unit 102, although in other embodiments battery or other power input systems may alternatively or additionally be included in one or both of the first and second speaker units 102 and 104. In some embodiments, the second speaker unit 104 may be powered by or through the first speaker unit 102. For instance, one or more electrical leads may connect the first speaker unit 102 to the second speaker unit 104. Power received by the first speaker unit 102 may be provided to the second speaker unit 104. Optionally, the second speaker unit 104 may include a battery or other power storage element that can be charged by the first speaker unit 102. In other embodiments, a battery or other power supply of the second speaker unit 104 may be removable and replaceable, or may be charged by means other than the first speaker unit 102. In some cases, the first and/or second speaker units 102, 104 may also provide additional power capabilities. For instance, the audio source 106 may include a rechargeable battery. By connecting the audio source 106 to the multi-speaker system 100, the rechargeable battery may be charged. In another embodiment one or both of the first and second speaker units 102 and 104 may include a USB output or other power output that can enable the charging of other electronic devices, such as an audio source 106.

Figure 4:
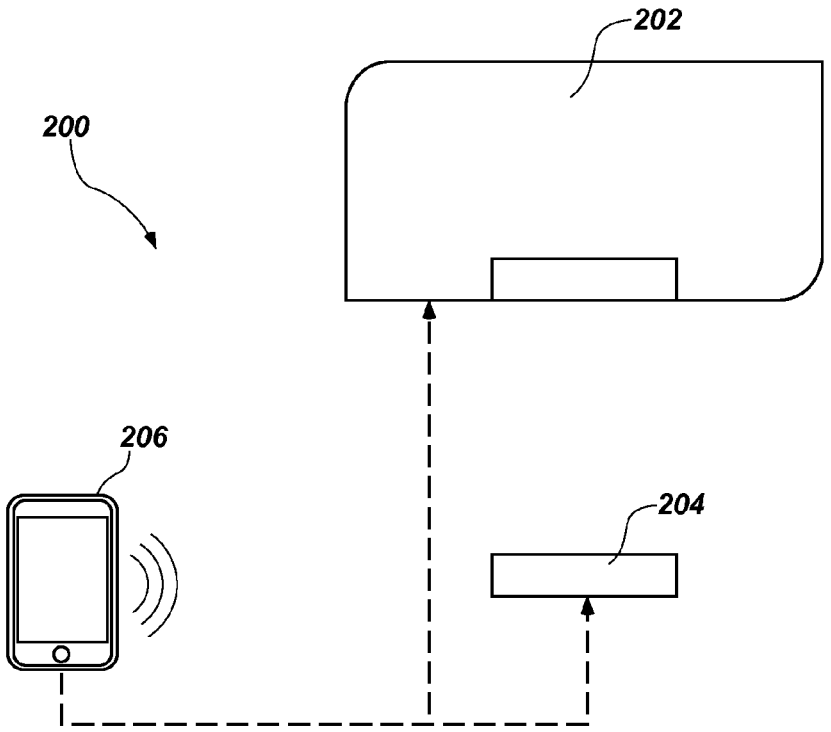
FIG. 4 schematically illustrates a communication system including an audio device and a multi-speaker system having a stationary speaker unit and a portable speaker unit.

Turning now to FIG. 4, an example of an audio system 200 that includes multiple speaker units is schematically illustrated. In the illustrated embodiment, a set of two speaker units 202, 204 may be connected to an audio source 206. The audio source 206 may be a smartphone, tablet, e-reader, laptop, desktop, stereo, multimedia player, or any other suitable source of audio information.

Optionally, the audio source 206 includes a wireless transmitter, and can communicate wirelessly with one or both of the speaker units 202, 204. In other embodiments, a hard-wired or other physical connection may be used, as illustrated by the dashed lines in FIG. 4. In some cases, communication may occur over wireless and physical connections, and optionally simultaneously.

The speaker units 202 and 204 are shown in FIG. 4 as being separated, but they may also be connected. When connected, either or both of the speaker units 202, 204 may continue to receive audio from the audio source 206. For instance, when speaker unit 204 is selectively attached to speaker unit 202, a communicative link can be established between the speaker units 202, 204 and the audio source 206. In such an embodiment, the speaker unit 204 may optionally receive audio signals or data and act as a full or partial bypass by sending all or some audio signals or data to the speaker unit 202 for audio output. Thus, the speaker units 202, 204 can act in a coordinated manner. If, however, the speaker unit 204 is detached from the speaker unit 204, the coordinated operation may cease. For instance, by virtue of the disconnection between the speaker units 202, 204, the speaker unit 204 may maintain or establish a communicative link with the audio source 206 and output audio through one or more loudspeakers of the speaker unit 204.

Figure 5:
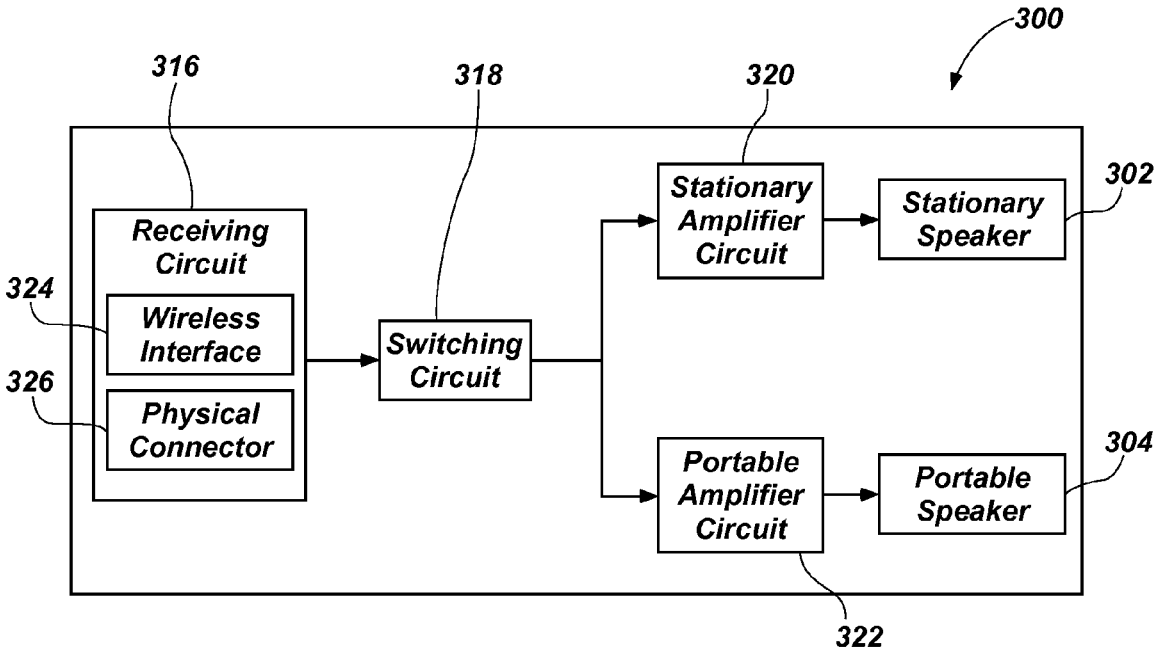
FIG. 5 schematically illustrates components of a multi-speaker system according to an embodiment of the present disclosure.
Figure 6A:
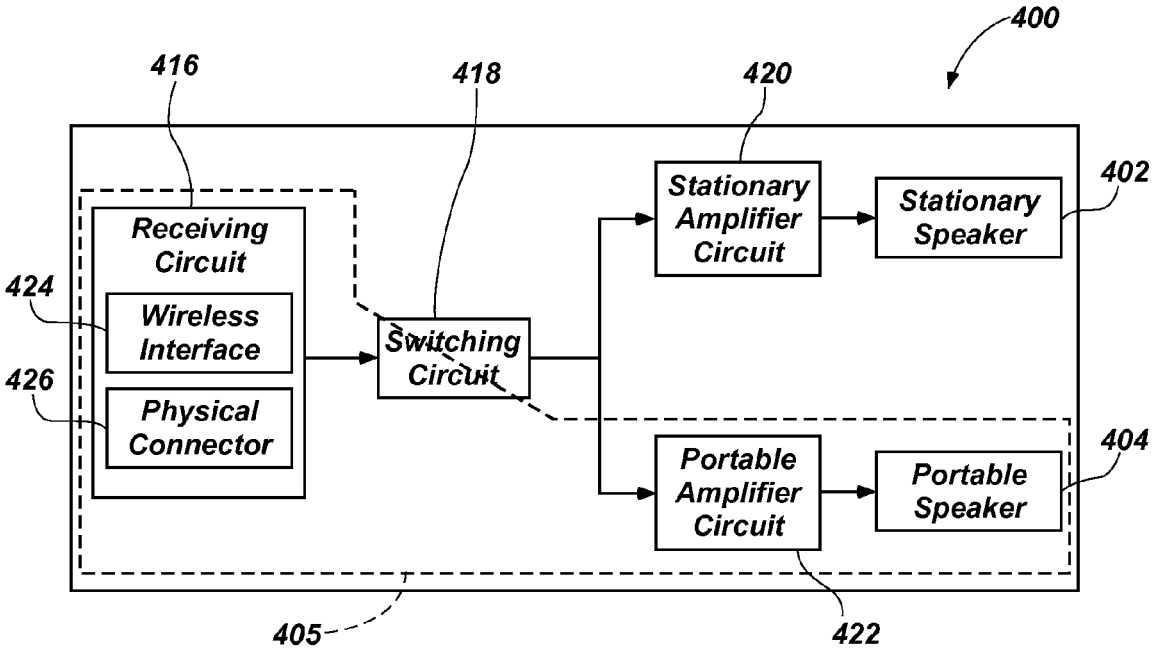
FIGS. 6A and 6B schematically illustrate embodiments of a multi-speaker systems similar to the embodiment of multi-speaker system depicted by FIG. 5, wherein a physical structure includes a stationary speaker unit, a portable speaker unit and one or more additional components.
Figure 6B:
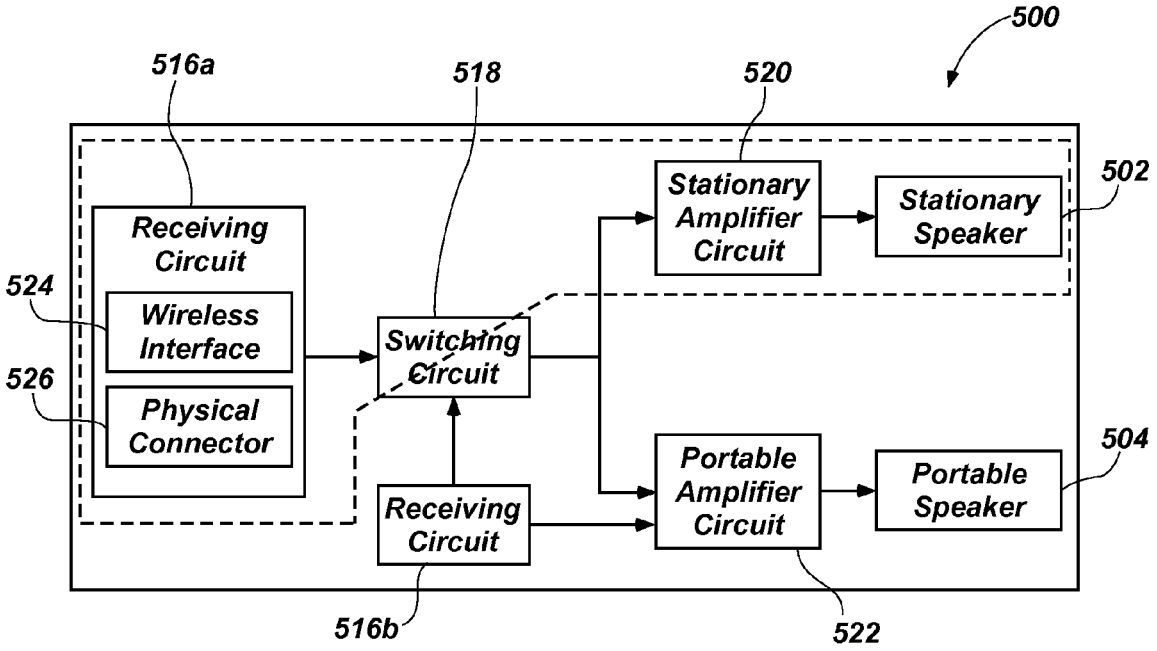

FIGS. 5-6B schematically illustrate various multi-speaker systems in accordance with some embodiments of the present disclosure. It should be appreciated that such illustrations are not intended to be limiting of the present disclosure, nor do they necessarily include all components that may be included in a multi-speaker system. Indeed, certain components (e.g., filter circuits, magnets, power supplies, etc.) that are well-known in the audio industry have been omitted to avoid obscuring aspects of the present disclosure.

The embodiment shown in FIG. 5 includes a multi-speaker system 300 including both a stationary speaker unit 302 and a portable speaker unit 304. Optionally, the physical structure of the multi-speaker system 300 may enable the portable speaker unit 304 to be moved, detached, or otherwise repositioned relative to the stationary speaker unit 302.

To convey information to the speaker units 302, 304, the multi-speaker system 300 may include a receiving circuit 316. The receiving circuit 316 may include components for receiving audio signals or data from an audio source. In some embodiments, the receiving circuit may receive audio signals or data wirelessly (e.g., using wireless interface 324) and/or using a hardwired or other physical connection (e.g., using a physical connector 326). Such a receiving circuit 316 may thus operate in any number of different manners. In some cases, the wireless interface 324 may receive a wireless signal. Such a signal may be according to any number of other protocols (e.g., AirPlay, Bluetooth, 802.11, radio frequency, near field communication, etc.). The physical connector 326 may also have any suitable construction, and can include standard or proprietary connectors or protocols. In some cases, other interfaces or combinations of different types of interfaces may be used. In at least one embodiment, for instance, a vibration sensor may be provided as part of the receiving circuit 316. Such a sensor may detect vibrations produced by an audio source 206 (FIG. 4) placed on or near the vibration sensor. The vibration sensor may be associated with one or more additional components that interpret and/or amplify the received vibrations to produce audio information that can be transmitted to one or more speakers of the multi-speaker system 300.

Optionally, the receiving circuit 316 may communicate with a switching circuit 318. In general, the switching circuit 318 may generally be used to identify or control where audio information is output. Based on the operation of the switching circuit 318, for instance, audio data may be transmitted to the stationary speaker unit 302, the portable speaker unit 304, or both.

The switching circuit 318 can operate autonomously or as a result of user input. In one embodiment, for instance, the portable speaker unit 304 may be removable from the stationary speaker unit 302. When the portable speaker unit 304 is removed, the switching circuit 318 may automatically indicate that audio data received by the receiving circuit 316 should be sent to the portable speaker unit 304. When the portable speaker unit 304 is then reconnected to the stationary speaker unit 302, the switching circuit 318 may automatically determine that all or some of the audio data should be transmitted to the stationary speaker unit 302. It should also be appreciated that the opposite may hold true and the switching circuit 318 could optionally determine that, when the portable speaker unit 304 is disconnected from the stationary speaker unit 302, audio information should be conveyed to the stationary speaker unit 302.

Regardless of when data is output to each of the speaker units 302, 304, optional stationary and portable amplifier circuits 320, 322 may be used to amplify sounds passed to respective speaker units 302, 304.

As discussed previously herein, a multi-speaker system may include multiple speakers that are optionally physically separable from one another. Accordingly, in some embodiments, components of a speaker system such as the multi-speaker system 300 depicted by FIG. 5 may be physically separated from other components by virtue of being included within different speaker housings or bodies. FIGS. 6A and 6B schematically illustrate some embodiments of the wide variety of possible manners in which components of a multi-speaker system may be physically separated from and associated with one another.

In particular, FIG. 6A, illustrates an example multi-speaker system 400 including a stationary speaker unit 402 and a portable speaker unit 404. The portable speaker unit 404 includes a speaker body 405 that houses one or more speakers. The operation of the multi-speaker system 400 may be similar to the multi-speaker system 300 of FIG. 5. In the illustrated embodiment, however, a receiving circuit 416 may be included within the physical speaker body 405 of the portable speaker unit 404. As an illustration, the speaker body 405 may be configured for portability. Whether near or remote from the stationary speaker unit 402, audio data may be received by the receiving circuit 416 (e.g., using a wireless interface 424, a physical connector 426, etc.). Audio data that is received may be processed and passed to a portable amplifier circuit 422 which can amplify the signal for the portable speaker unit 404. In some embodiments, a switching circuit 418 may be wholly or partially included within the speaker body 405 to direct audio data from the receiving circuit 416 to the portable speaker unit 404.

In other embodiments, components may be otherwise distributed. In FIG. 6B, for instance, a multi-speaker system 500 includes both a stationary speaker unit 502 and a portable speaker unit 504. In the illustrated embodiment, the stationary speaker unit 502 may include a stationary speaker body (see, e.g., speaker body 103 shown in FIGS. 1A-3) that may house one or more speakers. In such an embodiment, the stationary speaker body may also optionally house a receiving circuit 516*a* together with a wireless interface 524 and/or physical connector 526. Audio data received by the receiving circuit 516*a* may be processed and transferred to a stationary amplifier circuit 520 also housed within the speaker body, and from the stationary amplifier circuit 520 to the stationary speaker unit 502. Additionally, or alternatively, audio data received by the receiving circuit 516*a* may be transferred to a portable amplifier circuit 522 and/or portable speaker unit 504 outside of the speaker body of the stationary speaker unit 502.

In at least some embodiments, the multi-speaker system 500 may enable use of the portable speaker unit 504 when detached from the speaker body (see, e.g., speaker body 103 shown in FIGS. 1A-3) of the stationary speaker unit 502. According to at least one aspect of the present disclosure, for instance, the portable speaker unit 504 may be located remote from the stationary speaker unit 502. In such an embodiment, the multi-speaker system 500 may optionally include an additional receiving circuit 516*b* outside of the speaker body of the stationary speaker unit 502. Such a receiving circuit 516*b* may, for instance, be connected to the portable speaker unit 504. The receiving circuit 516*b* may be capable of connecting directly to an audio source using wireless, hardwired or other mechanisms. Alternatively, the receiving circuit 516*b* may connect to a network (e.g., the Internet, a LAN, a WAN, etc.) and communicate with the receiving circuit 516*a* of the multi-speaker system 500 to obtain audio data. Audio data received by the receiving circuit 516*b* may be transferred to the portable amplifier circuit 522 and/or the portable speaker unit 504 for output.

The embodiment in FIG. 6B may also use a switching circuit 518 to direct audio data to a suitable speaker unit 502, 504. In some embodiments, the switching circuit may be wholly within the speaker body (see, e.g., speaker body 103 of FIGS. 1A-3) of the stationary speaker unit 502, although in other embodiments it may be wholly exterior thereto or split between the speaker body and a body or housing of the portable speaker unit 504. Regardless of the particular implementation, the switching circuit 518 can be used to determine, either autonomously or based on user input, where audio data should be output.

In some embodiments, the switching circuit 518 may also act as a bypass mechanism for a default connection. For instance, in an embodiment of the present disclosure, a multi-speaker system 500 may be configured to transfer audio information, by default, to a particular speaker unit 502 or 504. When operating as a bypass mechanism, the switching circuit 518 may detect when specified conditions are present. If such conditions are met, the bypass mechanism may bypass the default configuration and allow data to be transferred to an alternative or additional speaker unit. If the conditions are not met, the default configuration may be used.

As an example, the switching circuit 518 may detect when bodies of the portable speaker unit 504 and stationary speaker unit 502 are connected. When the bodies are not connected, audio data received by components of the portable speaker body may by default be directed to the portable speaker unit 504. If, however, the bodies are connected, the switching circuit 518 may bypass such default configuration to send all or some of the audio data to the stationary speaker unit 502.

While embodiments of the present disclosure are described in relation to a system including two speaker units—namely one stationary speaker unit 502 and one portable speaker unit 504—it should be appreciated that such a system is merely illustrative and any number of other configurations may be provided. For instance, in at least one embodiment, multiple portable speaker units are provided. In such a system, each of the multiple portable speaker units may be removed from a central location, which is perhaps a larger or more stationary speaker unit. The multiple portable speaker units could be distributed around a room or other location. Such a configuration could allow multiple speaker units to be used to provide surround sound, without the need to run wires and hardwire or permanently secure speakers at particular locations. Such a system could even be entirely portable to provide a portable surround sound system. When such components can all be interconnected to a single central unit, the portability and convenience of the system can be increased.

Regardless of the particular configuration of a multi-speaker system, such a system can be used in any of myriad applications. For instance, a portable speaker unit may be removed from a larger speaker unit and used in a vehicle or at the office. While in the vehicle or office, a user may connect a phone thereto to amplify received audio and provide speakerphone capabilities with enhanced and/or amplified audio. In some embodiments, for example, the portable speaker unit, stationary speaker unit or both may include a microphone, thus enabling a user to provide audio input to the speaker via the user's voice, which can then be communicated back to the user's phone. A laptop, tablet, or other device may also be used to allow stored or streamed audio information, radio data, or other information to be passed through and amplified by the portable speaker unit.

In view of the multiple applications and embodiments disclosed and contemplated by the disclosure herein, it should be appreciated that no particular configuration or construction is required. Indeed, any number of configurations, materials, and the like may be used to design or produce a multi-speaker system of the present disclosure. According to at least some embodiments, a multi-speaker body may thus be produced from different materials including one or more of polymer, organic, metal, alloy, composite, or other materials. Indeed, in the embodiment shown in FIGS. 1A-1D, the speaker bodies 103 and 105 are each shown as having different portions or segments. Such segments may provide different functions or satisfy different purposes, may be made of different materials, or any combination of the foregoing. As also shown in FIGS. 1A-1D, in embodiments where multiple components, segments, sections or materials are used, the components on the speaker bodies 103 and 105 may be matched so that when the first and second speakers 102, 104 are connected, the second speaker unit 104 blends in with the first speaker unit 102. In at least one embodiment, a portion of the speaker bodies 103 and 105 may be made of a permeable material (e.g., a mesh, netting, porous material, etc.) to allow efficient transmission of audio data from inside the respective speaker body 103, 105 to the exterior thereof.

Although the foregoing description contains many specifics, these should not be construed as limiting the scope of the disclosure or of any of the appended claims, but merely as providing information pertinent to some specific embodiments that may fall within the scopes of the disclosure and the inventions of the appended claims. For instance, the term "stationary" may be used to describe a portion of a multi-speaker system for use with an audio input device. The term "stationary" is not intended to have a specific meaning requiring that a structure be immovable or permanently affixed in a precise location. Rather, a "stationary" element may instead be more stationary relative to another component which may be considered to be more "portable" or have increased "portability." In some embodiments, both the "portable" and "stationary" speaker units may be easily moved, transported and used in a variety of locations, including indoors, outdoors and with or without access to electrical wall outlets.

Features from different embodiments may be employed in combination. In addition, other embodiments of the present disclosure may also be devised which lie within the scopes of the disclosure and the appended claims. The scope of the present disclosure is, therefore, indicated and limited only by the appended claims and their legal equivalents. All additions, deletions and modifications to example embodiments, as disclosed herein, that fall within the meaning and scopes of the claims are to be embraced by the claims.

What is claimed:

1. A multi-speaker system, comprising:

a first loudspeaker consisting essentially of components for receiving, processing and amplifying audio signals from a separate portable electronic device and for outputting sound, the first loudspeaker configured to:

receive wireles sly streamed digital audio signals directly from a portable electronic device that is physically separate from the first loudspeaker; and provide an audio output corresponding to the wirelessly streamed digital audio signals output by the portable electronic device and received from the portable electronic device;

a second loudspeaker including a receptacle for receiving the first loudspeaker, the second loudspeaker including a speaker mount in the receptacle, the speaker mount configured to selectively attach the first loudspeaker to the second loudspeaker, the second loudspeaker configured to:

provide an output corresponding to the streamed digital audio signals output by the portable electronic device and received by the first loudspeaker only when the first loudspeaker is received by the receptacle of the second loudspeaker and selectively attached to the speaker mount of the second loudspeaker.

2. The multi-speaker system recited in claim 1, wherein the speaker mount is configured such that, when the second loudspeaker is selectively attached thereto, the first loudspeaker and the second loudspeaker are at least partially nested.

3. The multi-speaker system recited in claim 1, wherein the first loudspeaker is a portable loudspeaker and the second loudspeaker is a stationary loudspeaker.

4. The multi-speaker system recited in claim 1, wherein the first loudspeaker includes a first speaker body and the second loudspeaker includes a second speaker body, and wherein the speaker mount is defined at least partially by the second speaker body.

5. The multi-speaker system recited in claim 4, wherein the speaker mount comprises a receptacle.

6. The multi-speaker system recited in claim 5, wherein the receptacle has a shape and a configuration corresponding to the shape and configuration of the first speaker body.

7. The multi-speaker system recited in claim 1, further comprising:

an audio input configured to receive audio from a selectively connectable audio source.

8. The multi-speaker system recited in claim 7, wherein the audio input is included in the first loudspeaker.

9. The multi-speaker system recited in claim 1, wherein the first loudspeaker is configured to act as an audio bypass and provide at least some audio data received by the first loudspeaker to the second loudspeaker when the first loudspeaker is selectively attached to the speaker mount.

10. The multi-speaker system recited in claim 1, wherein the speaker mount is configured to selectively mount the first loudspeaker to the second loudspeaker, and in a manner substantially flush with a plurality of exterior surfaces of the second loudspeaker in which the receptacle is recessed.

11. The multi-speaker system recited in claim 1, wherein the second loudspeaker comprises a plurality of sections, wherein the first loudspeaker also comprises a plurality of sections matching those of the second loudspeaker to visually blend into the second loudspeaker.

12. The multi-speaker system recited in claim 1, wherein at least one of the first loudspeaker or the second loudspeaker includes exterior user interface controls for selectively controlling one or more of: volume; power on/off; audio device discovery; audio device syncing; or equalizer functions of the first loudspeaker or the second loudspeaker.

13. A multi-speaker audio system, comprising:

a portable loudspeaker consisting essentially of components for receiving, processing and amplifying audio signals from a separate portable electronic device and for outputting sound, the portable loudspeaker configured to:

receive wireles sly streamed digital audio signals directly from a portable electronic device that is physically separate from the portable loudspeaker; and provide an audio output corresponding to the wirelessly streamed digital audio signals output by the portable electronic device and received from the portable electronic device; and a stationary loudspeaker including a receptacle for receiving the portable loudspeaker and a mounting component configured to selectively connect the portable loudspeaker thereto, the stationary loudspeaker configured to:

provide an output corresponding to the wireles sly streamed digital audio signals output by the portable electronic device and received by the portable loudspeaker only when the portable loudspeaker is received by the receptacle of the stationary loudspeaker and selectively connected to the mounting component of the stationary loudspeaker.

14. The multi-speaker audio system recited in claim 13, wherein the receptacle is configured to enable the portable loudspeaker to nest within the stationary loudspeaker.

15. The multi-speaker system recited in claim 13, wherein the portable loudspeaker and the stationary loudspeaker are configured to operate independently when the portable loudspeaker is selectively detached from the mounting component of the stationary loudspeaker.

16. The multi-speaker system recited in claim 13, wherein the portable loudspeaker and the stationary loudspeaker are configured to operate in a coordinated manner when the portable loudspeaker is selectively connected to the mounting component of the stationary loudspeaker.

17. The multi-speaker system recited in claim 16, wherein the portable loudspeaker is configured to pass audio data to the stationary loudspeaker when the portable loudspeaker is selectively connected to the mounting component of the stationary loudspeaker.

18. The multi-speaker system recited in claim 13, wherein the portable loudspeaker and the stationary loudspeaker are configured to selectively operate in each of independent and coordinated modes.

19. The multi-speaker system recited in claim 13, further comprising:

a switching component configured to determine whether to output audio data through the portable loudspeaker, the stationary loudspeaker, or both.

20. The multi-speaker system recited in claim 19, wherein the switching component evaluates whether a direct, physical connection exists between the portable loudspeaker and the stationary loudspeaker at the mounting component.

21. A method for using a multi-speaker system, comprising:

establishing a communicative link between an audio source, comprising a portable electronic device, and a first loudspeaker consisting essentially of components for receiving, processing and amplifying audio signals and for outputting sound, the first loudspeaker being a device that is separate and independent from the portable electronic device; and selectively inserting the first loudspeaker into a receptacle of a second loudspeaker, the first loudspeaker being more portable than the second loudspeaker; and communicating a wirelessly streamed digital audio signal from the audio source, directly to and through the first loudspeaker and to the second loudspeaker to enable the first loudspeaker and the second loudspeaker to operate in a coordinated manner to output audio data received from the audio source.

22. A method for outputting audio data using a multi-speaker system, comprising:

communicating audio signals directly between a portable audio input device and a portable loudspeaker, which is separate and independent from the audio input device and consists essentially of components for receiving, processing and amplifying audio signals and for outputting sound, prior to establishing communication between the portable loudspeaker and a stationary loudspeaker;

inserting the portable loudspeaker into a complementary receptacle of the stationary loudspeaker while the portable loudspeaker provides an audio output corresponding to wirelessly streamed digital audio signals from the audio input device, the portable loudspeaker concurrently terminating the audio output and the stationary loudspeaker simultaneously initiating an audio output corresponding to the wirelessly streamed digital audio signals from the audio input device.

23. The method of claim 21, further comprising:

selectively removing the first loudspeaker from the second loudspeaker, causing the first loudspeaker and the second loudspeaker to cease operating in a coordinated manner.

* * * * *